US011033928B2

(12) United States Patent
Stephenson

(10) Patent No.: US 11,033,928 B2
(45) **Date of Patent: *Jun. 15, 2021**

(54) CAULKING FINGER

(71) Applicant: FWMM Products, LLC, Roswell, GA (US)

(72) Inventor: Daniel Todd Stephenson, Monticello, GA (US)

(73) Assignee: FWMM Products, LLC, Roswell, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/926,894

(22) Filed: Jul. 13, 2020

(65) Prior Publication Data

US 2020/0338587 A1 Oct. 29, 2020

Related U.S. Application Data

(63) Continuation of application No. 16/296,164, filed on Mar. 7, 2019, now Pat. No. 10,710,112.

(60) Provisional application No. 62/640,957, filed on Mar. 9, 2018.

(51) Int. Cl.
*B05C 17/10* (2006.01)
*E04F 21/165* (2006.01)

(52) U.S. Cl.
CPC ..... *B05C 17/10* (2013.01); *E04F 21/165* (2013.01)

(58) Field of Classification Search
CPC ..... B05C 17/10; E04F 21/165
See application file for complete search history.

(56) References Cited

U.S. PATENT DOCUMENTS

| | | | |
|---|---|---|---|
| 3,761,992 | A | 10/1973 | Schneller |
| 3,846,060 | A | 11/1974 | Otis |
| 4,211,501 | A | 7/1980 | Pedroso et al. |
| 4,586,890 | A | 5/1986 | Marchbanks |
| 4,817,229 | A | 4/1989 | Sedillo |
| 5,017,113 | A | 5/1991 | Heaton et al. |
| D332,901 | S | 2/1993 | Campbell |
| 5,301,843 | A | 4/1994 | Groene et al. |
| D355,576 | S | 2/1995 | Groene et al. |
| 5,675,860 | A | 10/1997 | Campbell |
| D422,121 | S | 3/2000 | Peck |
| 6,035,536 | A | 3/2000 | Dewberry |
| 6,219,878 | B1 | 4/2001 | Dewberry |
| D441,627 | S | 5/2001 | Hebert |
| D459,478 | S | 6/2002 | Perricone |
| D468,980 | S | 1/2003 | Woods |
| 7,033,099 | B2 | 4/2006 | Moutinho |
| 7,644,467 | B2 | 1/2010 | Kleinhammer |
| D634,600 | S | 3/2011 | Gringer et al. |
| 7,950,099 | B1 | 5/2011 | Hanson et al. |
| 8,011,918 | B2 | 9/2011 | Erickson et al. |
| D653,813 | S | 2/2012 | Rogers |

(Continued)

OTHER PUBLICATIONS

Notice of Allowance, dated Apr. 7, 2020, from corresponding U.S. Appl. No. 16/296,164.

(Continued)

*Primary Examiner* — Andrew A Horton
(74) *Attorney, Agent, or Firm* — Brient IP Law, LLC

(57) ABSTRACT

A caulking finger includes a handle and a finger portion. The finger portion may be shaped according to a human finger and is elastic. The various curvatures, shapes, and pliable nature of the finger portion allows the caulking finger to press caulk into a seam or joint to a desired finish.

20 Claims, 10 Drawing Sheets

(56) References Cited

U.S. PATENT DOCUMENTS

| | | | |
|---|---|---|---|
| 8,523,467 | B2 | 9/2013 | Murray |
| D695,004 | S | 12/2013 | Lee et al. |
| D696,006 | S | 12/2013 | Lee et al. |
| 9,375,319 | B2 | 6/2016 | MacDuff |
| D773,912 | S | 12/2016 | Gringer et al. |
| 2003/0011204 | A1 | 1/2003 | Grizzle |
| 2010/0162509 | A1 | 7/2010 | Liao |
| 2011/0271477 | A1 | 11/2011 | Lien |

OTHER PUBLICATIONS

Notice of Allowance, dated Jun. 12, 2019, from corresponding U.S. Appl. No. 29/639,929.
Office Action, dated Dec. 13, 2019, from corresponding U.S. Appl. No. 16/296,164.
Restriction Requirement, dated Sep. 6, 2019, from corresponding U.S. Appl. No. 16/296,164.

CAULKING FINGER

CROSS-REFERENCE TO RELATED APPLICATIONS

This application is a continuation of U.S. patent application Ser. No. 16/296,164, filed Mar. 7, 2019, entitled "CAULKING FINGER," which claims the benefit of U.S. Provisional Patent Application Ser. No. 62/640,957, filed Mar. 9, 2018, entitled "CAULKING FINGER," the disclosures of which are hereby incorporated herein by reference in their entirety.

BACKGROUND

Caulking is a process often used by painters, construction workers, plumbers, handymen, and do-it-yourselfers. Caulk is a material used to seal of fill joints and seams between abutting or adjacent materials. The caulking process typically involves loading a caulk tube into a caulk gun. After cutting the tip off of the caulk tube according to a desired bead size, a trigger-actuated plunger is used to squeeze the caulk tube and push the caulk out of the tip. As caulk is squeezed out of the tip, the user pulls the caulk gun along the joint or seam to create a line of caulk, or caulk bead, along the desired location.

After applying the caulk bead, the user then finishes the caulk by spreading the caulk into the joint or seam, filling any gaps between the materials with caulk and smoothing the caulk to the desired finish. This finishing process is typically performed using a caulk tool. Caulk tools can take many forms. Often, the caulk tool is a flat, rigid, planar device having a number of straight edges with corners of varying radii. Flat straight edges of the caulk tool can be used to slide across the caulked seam to push the caulk into the seam and leave a smooth surface. Similarly, corners of the tool having a desired radius that most closely matches a corner being caulked may be used to smooth the bead into a corner. However, these tools are often inadequate since they are rigid. Surfaces, angled joints, and corners being caulked are often not uniform. Rigid caulk tools do not conform adequately to the seam or joint being caulked.

Professionals and do-it-yourselfers alike have conventionally used a finger to spread the caulk bead into the seam or joint being caulked. The pliability of a human finger provides a "tool" that conforms to the surfaces being caulked and adequately spreads and smooths the caulk bead into a finished configuration. However, using a human finger extensively as a caulk tool creates numerous problems for the user. Continued friction between the finger and the surfaces being caulked may create sores, blisters, or bleeding. This problem can be aggravated in outdoor conditions where the temperatures may be decreased. Additionally, when caulking between wood, concrete, or other materials that are susceptible to fracturing or cracking, splinters of the material may enter the user's finger when rubbing over the caulk bead.

It is with respect to these considerations and others that the disclosure made herein is presented.

SUMMARY

It should be appreciated that this Summary is provided to introduce a selection of concepts in a simplified form that are further described below in the Detailed Description. This Summary is not intended to be used to limit the scope of the claimed subject matter.

Concepts and technologies described herein provide for a caulking finger. According to one aspect, a caulking finger includes a handle and a finger portion coupled to the handle. The finger portion includes an elastic material and a cross-sectional shape having at least one curvature. The finger portion has a number of surfaces on a bottom side with a number of different radii of curvatures.

According to another aspect, a caulking finger includes a handle and a finger portion coupled to the handle. The finger portion is shaped according to a human finger and includes an elastic material and a number of transverse cross-sectional thicknesses from a tip of the finger portion to a base of the finger portion.

According to yet another aspect, a caulking finger includes a handle and a finger portion coupled to the handle. The finger portion is shaped according to a human finger and includes an elastic material and a joint. The joint is located at approximately a position corresponding to a middle portion of the finger portion between a fingertip and a base end. The joint includes a number of surfaces and curvatures.

The features, functions, and advantages that have been discussed can be achieved independently in various embodiments of the present disclosure or may be combined in yet other embodiments, further details of which can be seen with reference to the following description and drawings.

DETAILED DESCRIPTION

Figure 1:
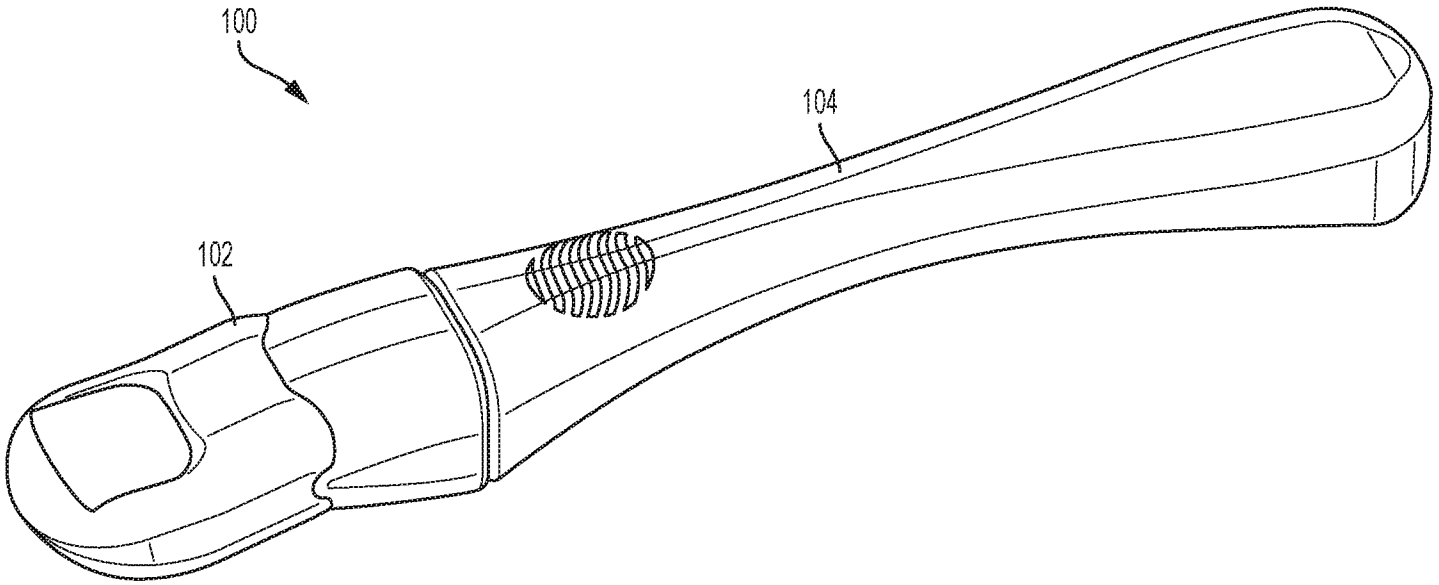
FIG. 1 is a perspective view of a caulking finger according to various embodiments described herein.

The following detailed description is directed to a caulking finger for use with finishing a caulk bead while sealing a seam or joint with caulk. In addition, the following detailed description is directed to an efficient method of manufacturing a caulking finger. For the purposes of this disclosure, the term "caulk" will be used to describe any type of filler, sealant, and/or viscous material that may be spread into a seam or joint. As discussed above, conventional caulk tools are rigid and flat, having straight edges and rounded corners for smoothing caulk along flat seams and corners, respectively. These tools do not adequately compensate for situations in which the surfaces being caulked are not perfectly planar or angled according to the tool.

For this reason, many users primarily find themselves using his or her finger to spread the caulk bead over the seam or joint. Using a human finger often provides the desired results when finishing a caulk bead. However, continuous use of a human finger may result in damage to the skin of the finger, may create blisters or general discomfort from the friction, and may even result in splinters from the material in contact with the human finger.

Utilizing the concepts and technologies described herein, a caulking finger is provided to mimic the beneficial aspects of using a human finger for finishing a caulk bead, while eliminating the physical detriments associated with doing so. In the following detailed description, references are made to the accompanying drawings that form a part hereof, and which are shown by way of illustration, specific embodiments, or examples. Referring now to the drawings, in which like numerals represent like elements through the several figures, a caulking finger according to the various embodiments will be described.

Figure 2:
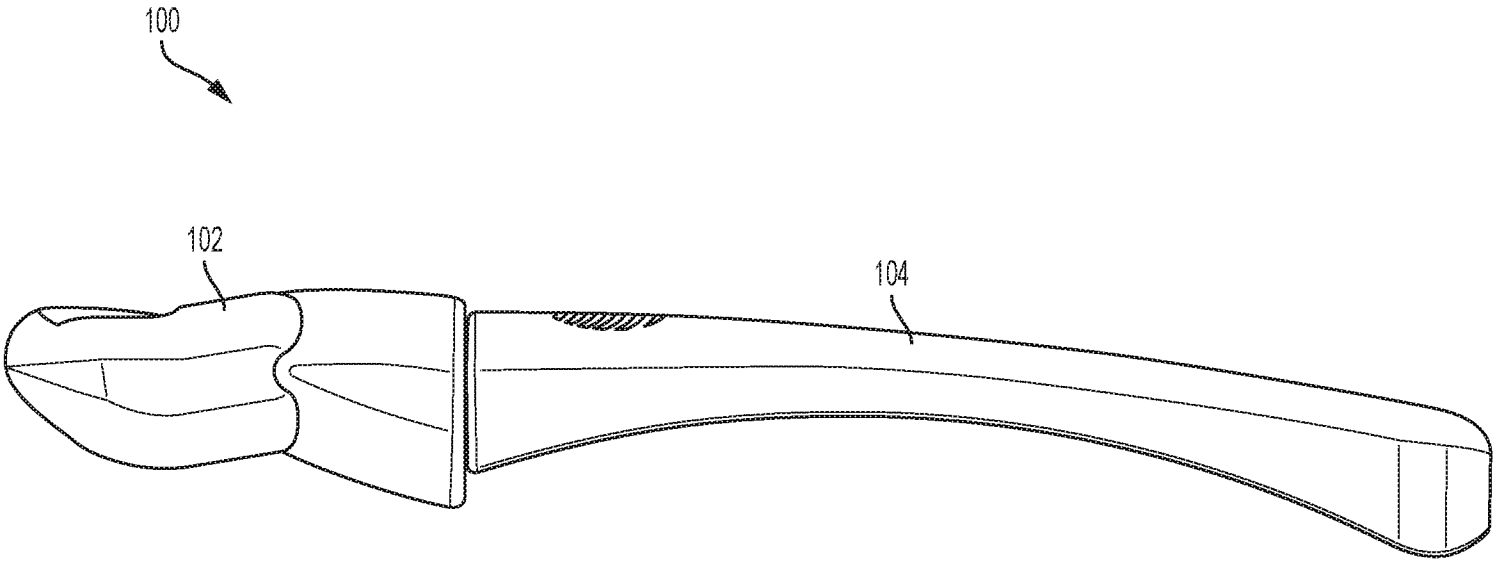
FIG. 2 is a side view of a caulking finger according to various embodiments described herein.
Figure 3:
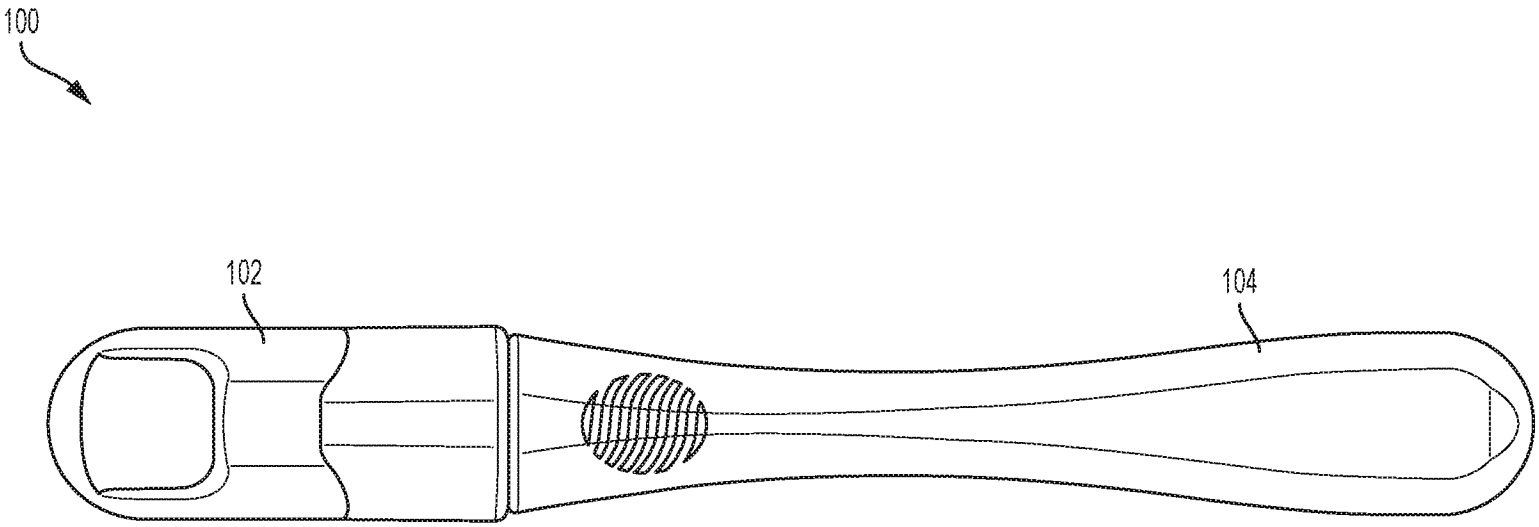
FIG. 3 is a top view of a caulking finger according to various embodiments described herein.

FIGS. 1-3 show perspective, side, and top views, respectively, of a caulking finger 100 according to various embodiments described herein. The caulking finger 100 includes a finger portion 102 and a handle 104. The finger portion 102 resembles a human finger and is pliable and elastic like a human finger. According to various embodiments, the finger portion 102 may be made from an elastomer (i.e., rubber), a thermoplastic, a thermoplastic elastomer, a polymer, silicone, any combination thereof, and/or any suitable material having the desired elastic characteristics. According to one embodiment, the material of the finger portion 102 includes Dynaflex G6713. The elastic material may have a durometer hardness score between approximately 10A and 30A on the Type A hardness scale. According to one embodiment, the material of the finger portion 102 has approximately a 14A durometer hardness score.

The handle is rigid or semi-rigid, allowing the user to grasp the handle 104 in one hand and apply the finger portion 102 to a caulk bead to tool the caulk into a desired finish. The caulking finger 100 provides significant advantages over a traditional caulk tool that is rigid and planar. The pliability of the finger portion 102 of the caulking finger 100, coupled with the varying surfaces and curvatures of the finger portion 102, allow the user to precisely press and smooth a caulk bead into any seam, joint, or crevice to create a seal having a desired finish. The user simply holds the handle 104 and presses the desired surface of the finger portion 102 onto the caulk bead and pulls the caulking finger 100 along the caulk bead while applying the desired amount of pressure to press the caulk into the seam or joint and smooth out the caulk bead.

As mentioned above, the varying elastic surfaces and curvatures of the caulking tool 100 provide an advantage over conventional rigid and flat caulk tools. As an example, a flat rigid caulk tool having perpendicular edges can be used to spread a caulk bead into a corner between perpendicular surfaces. However, the thickness or characteristics of the resulting seam is defined by the radius of curvature between the perpendicular adjacent edges of the flat rigid caulk tool. If the radius of curvature between perpendicular adjacent edges is large, the resulting caulk seam will be relatively thick. If the radius of curvature between perpendicular adjacent edges is small (i.e., resulting in a "sharp" corner between the perpendicular adjacent edges), the resulting caulk seam will be relatively thin. There is no way to vary the thickness of the caulk seam using the same tool. Similarly, if the caulk is applied to a joint between surfaces that are not perpendicular to one another, then a conventional flat rigid caulk tool that has perpendicular adjacent edges cannot be used.

In contrast, the caulking finger 100 allows a user to apply caulk in any desired thickness along seams between surfaces that are positioned at any angle with respect to one another. The caulking finger 100 provides various surfaces having various curvatures and configurations, including flat. Moreover, the pliability and elasticity of the caulking finger 100 allows the user to adjust the thickness of the caulk seam by utilizing a desired surface configuration and applying a desired amount of pressure. For example, to press the caulk deeper into a joint and/or to create a relatively thin caulk seam, the user may apply more pressure with a portion of the caulking finger 100 having the desired radius of curvature against the joint. To create a thicker caulk seam, the user may apply less pressure to the caulking finger 100 and/or adjust the caulking finger 100 to apply a portion of the tool having a larger radius of curvature against the joint.

Figure 4:
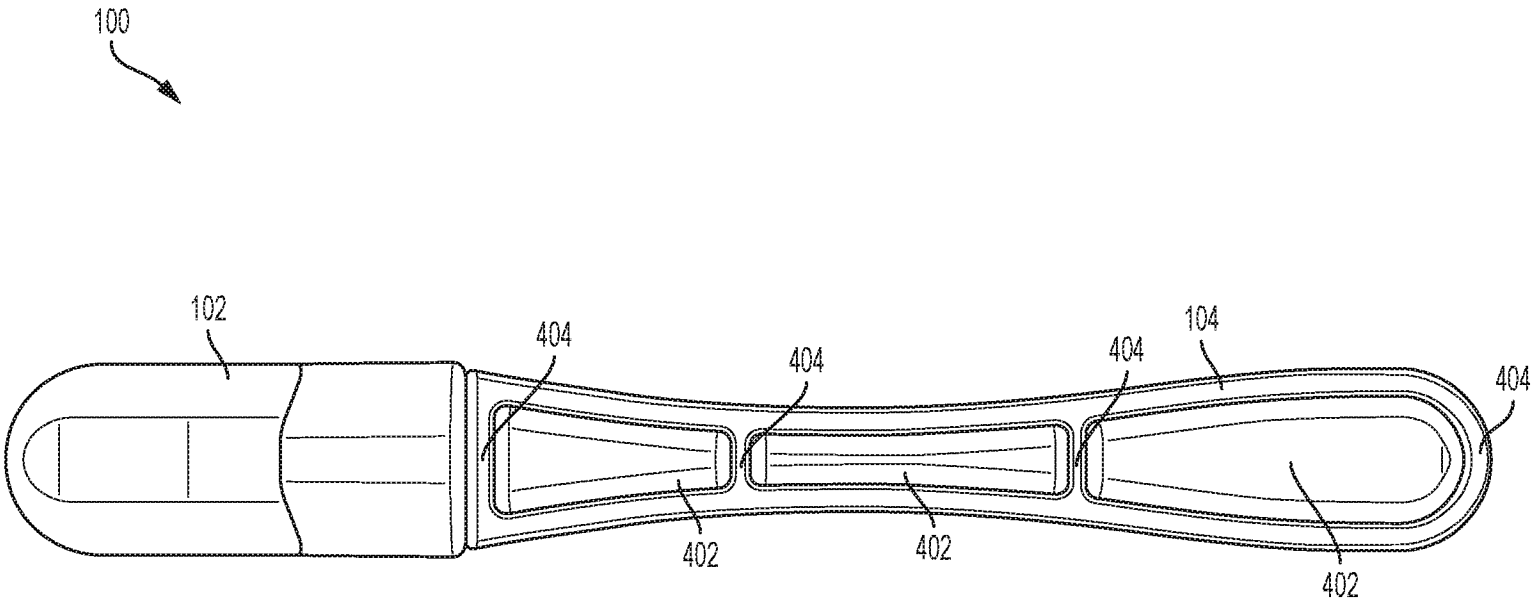
FIG. 4 is a bottom view of a caulking finger according to various embodiments described herein.

Turning now to FIG. 4, a bottom view of the caulking finger 100 according to various embodiments is shown. In this example, the handle 104 has handle cavities 402 exposed to a bottom side of the caulking finger 100. Although three handle cavities 402 are shown, any number of handle cavities 402, including zero, may be included with the handle 104 without departing from the scope of this disclosure. Moreover, the handle cavities 402 may be configured on any side or portion of the handle 104 rather than being exposed to the bottom side of the handle 104 as shown.

The handle cavities 402 may provide a user with alternative options for gripping the caulking finger 100. For example, the handle cavities 402 create handle bridges 404 that are located between or adjacent to the handle cavities 402. The handle bridges 404 may include any edge of the handle 104 that is adjacent to a handle cavity 402. To hold the caulking finger 100, the user may grip the handle 104 between thumb and forefinger or between thumb and numerous other fingers, similar to holding a pencil or eating utensil. Alternatively, the user may grip the handle 104 with the palm of his or her hand in much the same way that a user might grip a racket. The handle cavities 402 provide yet another alternative option for holding the caulking finger 100. The user may pinch a handle bridge 404 between the thumb and forefinger to hold and use the caulking finger 100. The number and locations of the handle bridges 404 provide endless options for using the caulking finger 100 in varying positions and caulking locations.

The user may additionally slide his or her finger into a handle cavity 402 to "wear" the caulking finger 100 as an extension of the human finger inserted within. In these embodiments, the handle cavities 402 may extend through the handle bridges 404 rather than being separated into separate cavities by the handle bridges 404. In this manner, the handle bridges 404 function to hold the caulking finger 100 onto the user's finger while caulking.

While the handle cavities 402 may provide the user with gripping options, the handle cavities 402 additionally provide manufacturing advantages. By creating the handle cavities 402 in the handle 104, less material is used as compared to a handle 104 that is solid or even hollow with a continuous outer surface. The decreased material, coupled with the increased surface area of the handle created by the handle cavities 402, results in a decreased drying time for the material in the handle as well. Decreased material and decreased drying time increases the efficiency of the manufacturing process and decreases costs.

Figure 5:
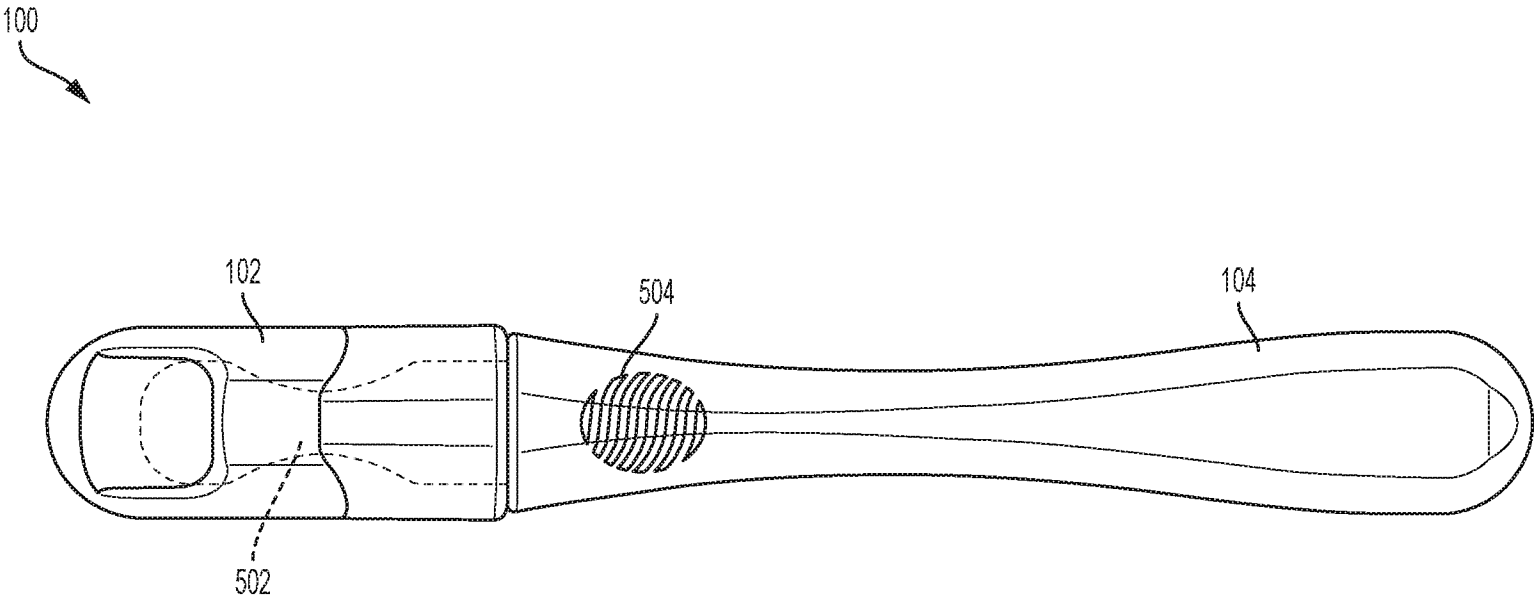
FIG. 5 is a top view of a caulking finger showing a finger engagement tab of a handle within a finger portion according to various embodiments described herein.
Figure 6:
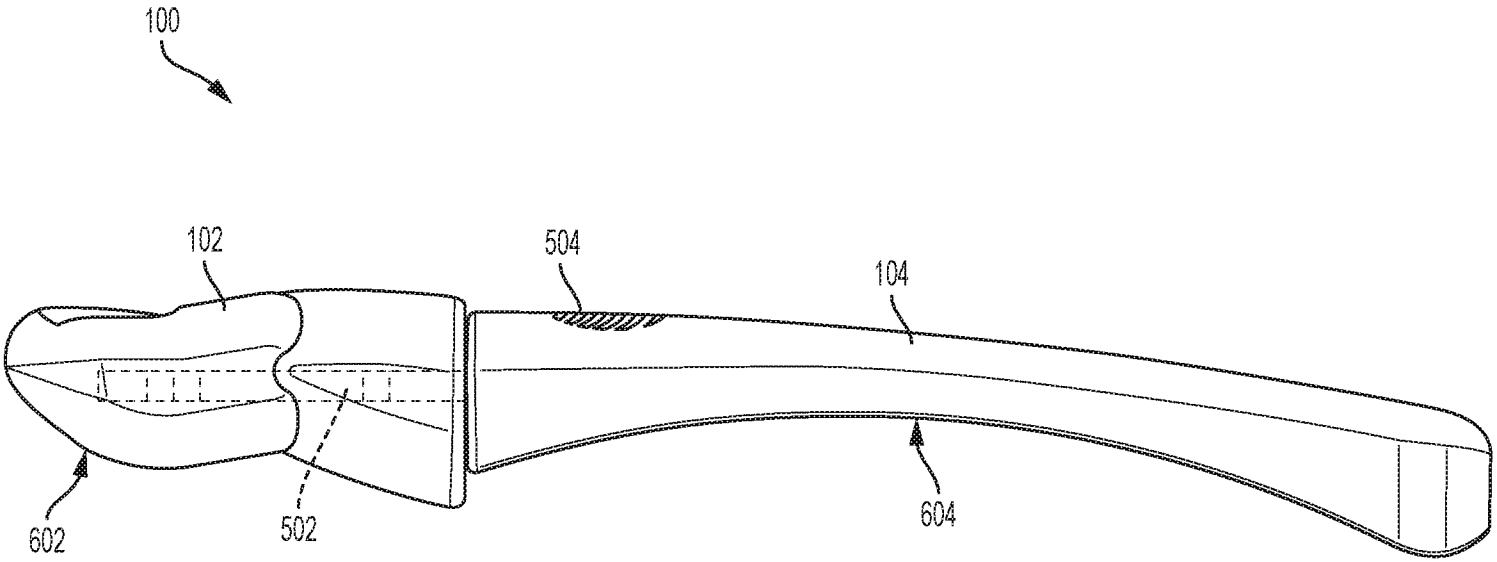
FIG. 6 is a side view of the caulking finger of FIG. 5 showing the finger engagement tab of the handle within the finger portion according to various embodiments described herein.

Turning now to FIGS. 5 and 6, top and side views, respectively, of a caulking finger 100 showing a finger engagement tab 502 of a handle 104 will be described. According to various embodiments, the handle 104 and the finger portion 102 of the caulking finger 100 are secured to one another after manufacturing using a finger engagement tab 502 of the handle 104. The finger engagement tab 502 is shown in FIGS. 5 and 6 in broken lines to indicate approximate positioning of the finger engagement tab 502 within the finger portion 102 when the caulking finger 100 is assembled.

The handle 104 of the caulking finger 100 may be manufactured from any plastic, polymer, composite, or other material that results in a rigid or semi-rigid characteristic of the handle 104. According to one embodiment, the handle 104 is manufactured from Acrylonitrile Butadiene Styrene (ABS) or other thermoplastic or thermoset polymers. The handle 104 has sufficient stiffness to transfer force applied by the user to the finger portion 102 for application to the caulk bead. The handle 104 has a greater stiffness or hardness than the finger portion 102. For example, the durometer value or range of the handle 104 is greater than that of the finger portion 102, according to one embodiment. The finger portion 102 may be manufactured from an elastomer or other material that provides the surfaces of the finger portion 102 with the flexibility and pliability that will conform to the seam or joint being caulked when force is applied by the user via the handle 104. Example elastomeric materials include, but are not limited to, various rubber materials, silicone, and similar materials. According to one embodiment, the finger portion 102 is manufactured from a thermoplastic elastomer.

Figure 7A:
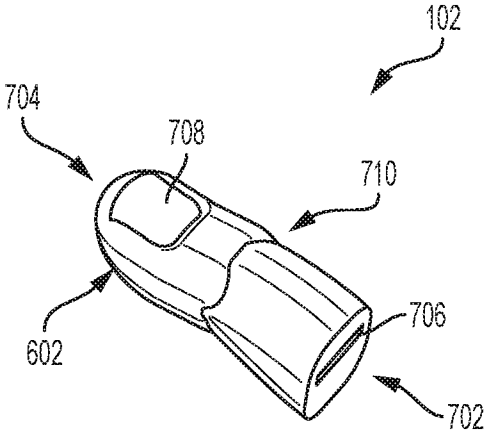
FIG. 7A is a perspective view of a finger portion of a caulking finger according to various embodiments described herein.
Figure 7B:
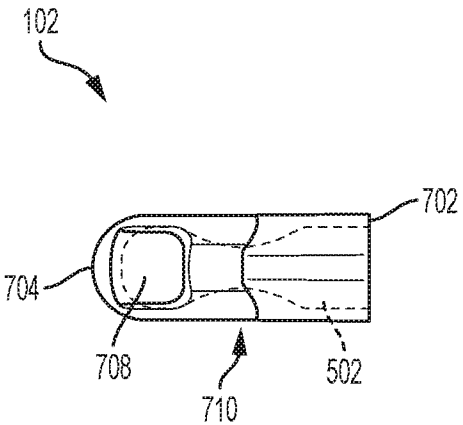
FIG. 7B is a top view of the finger portion of FIG. 7A according to various embodiments described herein.

As will be described in greater detail below with respect to FIGS. 7B-7D, the finger portion 102 may include a tab engagement recess that is shaped and sized to receive the finger engagement tab 502 of the handle 104. During assembly of the caulking finger 100, the finger portion 102 is pushed onto the finger engagement tab 502 of the handle so that the finger engagement tab 502 slides into the tab engagement recess. Complimentary contouring or features of the tab engagement recess and the finger engagement tab 502 secure the finger portion 102 in place. Adhesive or other securing techniques may additionally be used to fixedly secure the finger portion 102 to the handle 104.

As seen in FIGS. 5 and 6, according to this embodiment, the finger engagement tab 502 of the handle 104 extends into the finger portion 102 to a position proximate the tip of the finger. By doing so, the finger engagement tab 502 provides a structure of greater stiffness or hardness than the finger portion 102 to support the finger portion 102 during use. When the finger portion 102 is pressed against the caulk bead and the surfaces being caulked, the material of the finger portion 102 will deform to conform to the seam or joint. The finger engagement tab 502 within the finger portion 102 provides support and prevents the finger portion 102 from bending or deforming excessively or undesirably. In other words, the finger engagement tab 502 not only aids in securing the finger portion 102 to the handle 104, but also acts in a similar manner to the bone in a human finger, providing support for the more pliable or elastic material of the finger portion 102. It should be appreciated that the shape, size, and dimensions of the finger engagement tab 502 may be modified without departing from the scope of this disclosure.

FIG. 6 shows a good view (along with FIGS. 7A-7E) of the curvature 602 of the surfaces of the finger portion 102. The curvature 602 of the various surfaces of the finger portion 102 mimic the various curved surfaces of a human finger. This curvature 602, coupled with the pliable and elastic material of the finger portion 102, allows a user to efficiently finish a caulk bead by pressing the caulk into the seam or joint while smoothing the caulk bead to a desired finish. This action is substantially the same as a user could perform with his or her own finger, but without the pain and problems associated with extended use of a human finger during caulking operations.

The handle 104 may include any number and type of features that aid in gripping or using the caulking finger 100. As previously discussed, the handle cavities 402 and corresponding handle bridges 404 may aid the user in gripping the caulking finger. In addition, the handle 104 may include a haptic feature 504 that assists the user in gripping the handle 104 or guides the user in holding the caulking finger 100 in an efficient manner. For example, looking at FIG. 5, this example includes a haptic feature 504 that includes a raised or embossed portion in a location at which the user may place his or her forefinger while using the caulking finger 100. This haptic feature 504 provides extra grip that prevents the user's forefinger from slipping off of the handle 104 during use when the handle 104 gets wet, while also suggesting an efficient location for placement of the user's forefinger during use which aids in the caulking finger 100 acting as and extension of the user's finger. Any number and type of haptic features 504 may be placed at any location on the handle 104.

Moreover, the handle 104 may be shaped to provide an ergonomic and comfortable caulking finger component for a user to hold during use. According to one embodiment shown in FIG. 6, the handle 104 has a curved bottom edge 604 that narrows the width of the handle 104 at a middle portion of the length of the handle. This narrowing of the width due to the curved bottom edge 604 allows for a user's fingers to comfortably wrap around the handle 104 while placing a forefinger on the haptic feature 504. It should be appreciated that any shape and configuration may be used with respect to the handle 104 without departing from the scope of this disclosure.

FIGS. 7A-7E show various views of the finger portion 102 of the caulking finger 100. According to various embodiments, the finger portion 102 is substantially shaped according to a human finger or thumb. As used throughout this disclosure, the term "finger" or "human finger" encompasses any finger, thumb, toe, or human digit. Because the finger portion 102 is substantially shaped according to a human finger, the finger portion 102 visually resembles a human finger. According to one embodiment, the finger portion 102 is substantially shaped according to a human finger such that the finger portion 102 has various contours of a human finger. According to other embodiments, the finger portion 102 is substantially shaped according to a human finger to include features of a human finger like a nail and/or joint.

The finger portion 102 has a tab engagement recess 706 at a base end 702 for receiving the finger engagement tab 502 of the handle 104, as discussed above. The finger portion 102 may have a nail 708 positioned appropriately near the fingertip 704. According to one embodiment, the nail 708 is made of the same material as the rest of the finger portion 102, and is consequently pliable. The surface of the nail 708 and the corresponding surfaces of the finger portion 102 around the nail 708 that transition from the nail 708 to the surrounding finger portion 102 provide the user with multiple areas of varying curved and angled surfaces with which to manipulate the caulk bead. In this manner, the finger portion 102 not only resembles a human finger or thumb, but offers functional benefits to the user by providing numerous and varying caulk finishing surfaces that are useful for smoothing and finishing caulk, and even for storing excess caulk that is wiped off of a surface or out of a seam or joint.

According to an alternative embodiment, the nail 708 may be a plastic component or other rigid and/or semi-rigid material that is of greater rigidity than the finger portion. The nail 708 may extend beyond the fingertip 704 and may provide a straight edge that may be used in a similar manner as a conventional planar, rigid caulking tool. In this embodiment, the nail 708 may be attached to and manufactured from the same material as the finger engagement tab 502 of the handle 104.

The finger portion 102 may include a joint 710 located at approximately a position corresponding to a joint of a human thumb that is at a middle portion of the finger portion 102 between the fingertip 704 and the base end 702. According to various embodiments, the joint 710 does not allow the fingertip 704 to pivot around the joint 710 with respect to the base end 702. Rather, the joint 710 mimics a human thumb or finger joint with respect to appearance and provides additional surfaces and curvatures of the caulking finger 100 with which to tool a caulk bead in a desired manner.

Figure 7C:
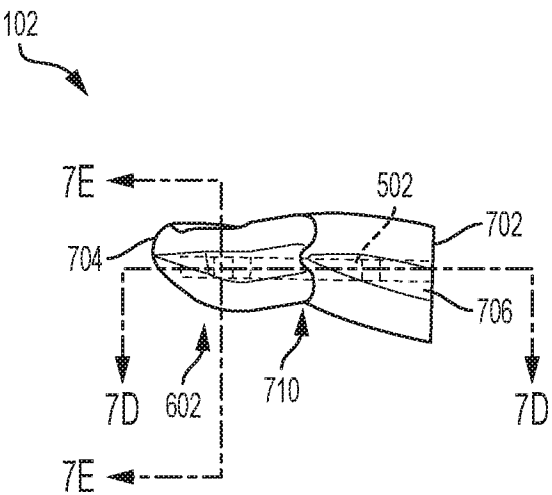
FIG. 7C is a side view of the finger portion of FIG. 7B according to various embodiments described herein.
Figure 7D:
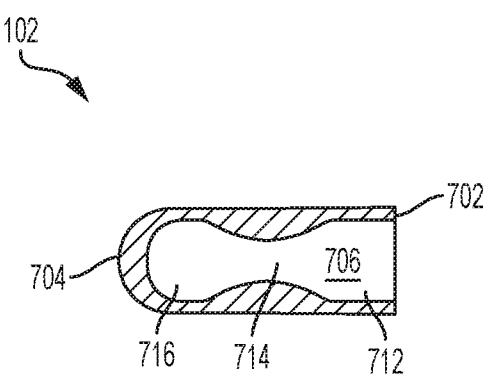
FIG. 7D is a cross-sectional view taken along lines 7D-7D of the finger portion of FIG. 7C according to various embodiments described herein.
Figure 7E:
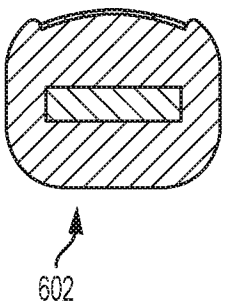
FIG. 7E is a cross-sectional view taken along lines 7E-7E of the finger portion of FIG. 7C according to various embodiments described herein.

FIG. 7D shows a cross section of the finger portion 102 along the lines 7D-7D of FIG. 7C. This cross-sectional view is a longitudinal cross section as it is taken along a longitudinal plane that is parallel with a longitudinal axis extending from the fingertip 704 to the base end 702 of the finger portion 102. As shown, the tab engagement recess 706 is shaped according to the finger engagement tab 502 of the handle 104. FIG. 7E shows a cross section of the finger portion 102 along the lines 7E-7E of FIG. 7C. This cross-sectional view is a transverse cross section as it is taken along a transverse plane that is perpendicular to a longitudinal axis extending from the fingertip 704 to the base end 702 of the finger portion 102. As shown, the cross-sectional shape of the finger portion 102 is substantially curved around a perimeter of the transverse cross section, corresponding to an outer surface of the finger portion 102. According to other embodiments, the transverse cross-sectional shape of the finger portion 102 is substantially circular or oval.

According to one embodiment, the transverse cross-sectional shape of the finger portion varies from the fingertip 704 to the base end 702. For example, the cross-sectional shape of the finger portion 102 may be substantially circular or oval proximate to the fingertip 704, transitioning to the cross-sectional shape shown in FIG. 7E at approximately a midpoint between the fingertip 704 and the joint 710. Moreover, the thickness of the finger portion cross-sections may vary from the fingertip 704 to the base end 702, allowing for variation in elasticity, pliability and/or rigidity along the length of the finger portion 102. In doing so, the user is provided with varying curvatures and surfaces for applying caulk in a desired manner according to the particular implementation and/or user preference.

This curvature 602 provides substantial advantages over a conventional caulking tool that is planar or flat on a side that engages with a caulk bead. The curvature 602 and elastic material of the finger portion 102 allows the user to apply an appropriate amount of pressure to the caulking finger 100, along a desired surface of the finger portion 102, to tool the caulk bead efficiently and easily. The pliability of the finger portion 102 allows the user to increase and decrease the desired force applied to the caulking finger to press the caulk into a seam or joint, adequately sealing the components while leaving a finished caulk line of a desired and uniform thickness. The finger portion 102 has a curvature 602 that varies in radii around the perimeter of the finger portion 102 cross section, similar to that of a human finger. This feature allows a user to rotate the finger portion to the desired radius of curvature according to the specific application or as desired according to personal preference.

According to various embodiments, the finger portion 102 may be described as having a varying pliability due to the variation in thickness from the fingertip 704 to the base end 702 and the inclusion of the finger engagement tab 502 within the finger portion 102 beginning at a longitudinal position that is aft of the fingertip 704. The term "varying pliability" may refer to the change in elasticity, pliability, and/or rigidity along the longitudinal length of the finger portion 102 from the fingertip 704 to the base end 702. This varying pliability provides a user with a substantial advantage over conventional rigid or semi-rigid caulk tools by allowing the user to utilize one or more portions of the finger portion 102 while finishing the caulk bead according to personal preference and the desired caulk finish. In fact, the varying pliability allows the user to dynamically change how he or she is finishing the caulk while pulling the caulk tool along the caulk bead by rotating the caulking finger 100 along a longitudinal axis and/or rotating the caulking finger 100 around any transverse axis (i.e., around the fingertip 704) with or without simultaneously adjusting the pressure applied to the finger portion 102 and corresponding caulk bead via the handle 104. The multiple surfaces, curvatures, and varying pliability characteristics of the caulking finger 100 facilitates the user's ability to customize the caulk finishing process according to user preference or the application requirements.

Figure 8B:
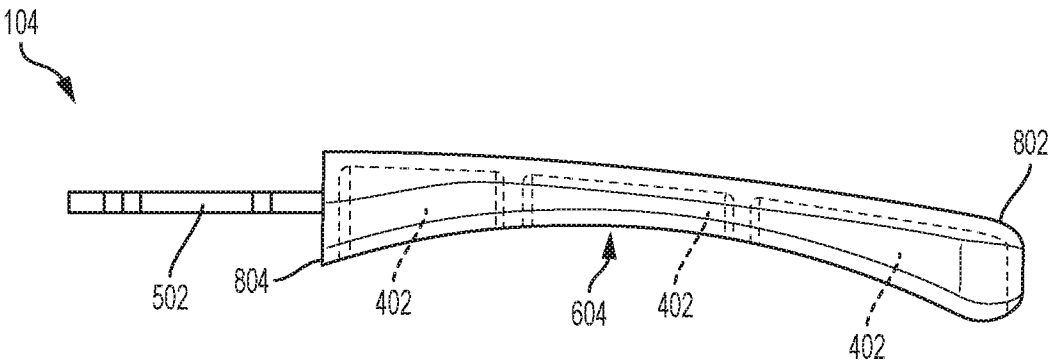
FIG. 8B is a side view of the handle of FIG. 8A according to various embodiments described herein.
Figure 8C:
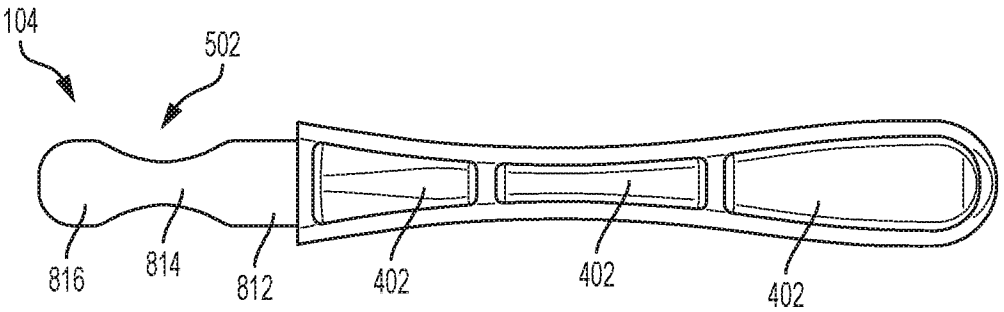
FIG. 8C is a bottom view of the handle of FIG. 8B according to various embodiments described herein.
Figure 8A:
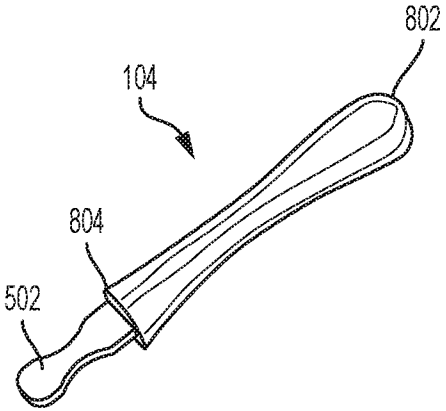
FIG. 8A is a perspective view of a handle of a caulking finger according to various embodiments described herein.

FIGS. 8A-8C show perspective, side, and bottom views of a handle 104 according to various embodiments. These views show the various features of the handle 104 discussed in detail above. Specifically, these drawings show the finger engagement tab 502 extending from the handle 104 at a finger engagement end 804 of the handle 104 opposite a base end 802 of the handle. According to this example, the finger engagement tab 502 has a base portion 812, a middle portion 814, and a tip portion 816. As seen, the width of the finger engagement tab 502, beginning with the base portion 812 at the finger engagement end 804 and moving outward, decreases at the middle portion before returning to substantially a same width at the tip portion 816 as the base portion 812. This configuration of the finger engagement tab 502 provides the desired structure to the finger portion 102 while facilitating engagement with and securement to the finger portion 102. However, any size and shape may be used with the finger engagement tab 502 without departing from the scope of this disclosure.

Figure 9:
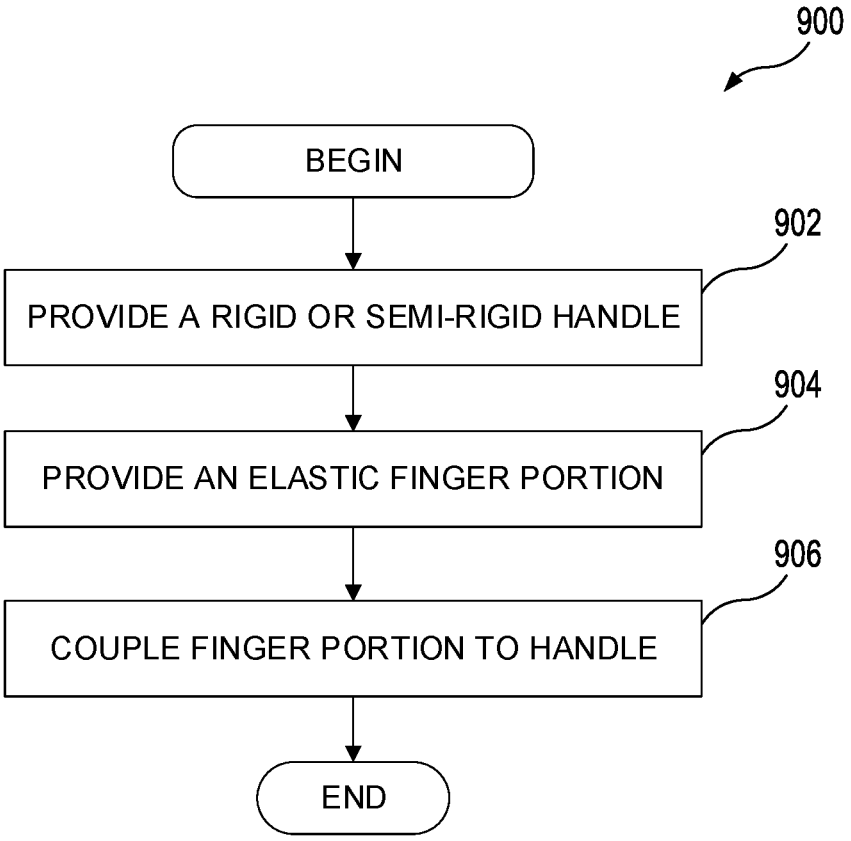
FIG. 9 is a flow diagram illustrating a method for providing a caulking finger according to various embodiments described herein.

Turning now to FIG. 9, an illustrative routine 900 for providing a caulk tool will now be described in detail. It should be appreciated that more or fewer operations may be performed than shown in FIG. 9 and described herein. Moreover, these operations may also be performed in a different order than those described herein. The routine 900 begins at operation 902, where a handle 104 is provided. As discussed above, the handle is made from a rigid or semi-rigid material. According to various embodiments, the handle 104 may have any number and type of features described herein, including but not limited to, a curved bottom edge 604 that narrows a width of the handle 104 at a middle portion of the length of the handle 104, one or more handle cavities 402 exposed to a bottom side of the caulking finger 100, and/or one or more haptic features 504. The handle 104 may be injection molded or manufactured from any suitable process.

At operation 904, a finger portion 102 is provided. The finger portion 102 is manufactured using injection molding or any other suitable techniques using an elastic or pliable material, as discussed above. The finger portion 102 is coupled to the handle 104 at operation 906. According to one embodiment, the coupling may be facilitated by engaging a finger engagement tab 502 of the handle 104 with a corresponding tab engagement recess 706 of the finger portion 102. The coupling may be secured using adhesive, overmolding techniques, or any other suitable techniques for coupling an elastic material to a rigid or semi-rigid material.

Figure 10:
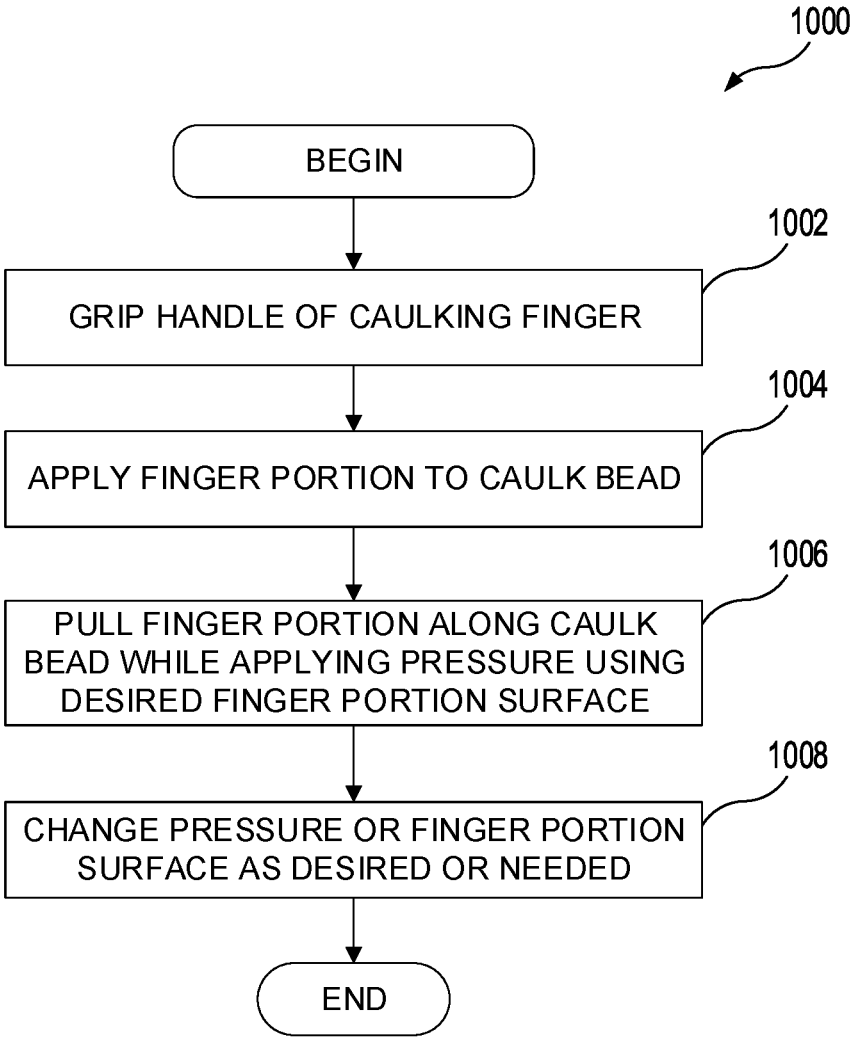
FIG. 10 is a flow diagram illustrating a method for finishing a caulk bead using a caulking finger according to various embodiments described herein.

Turning to FIG. 10, an illustrative routine 1000 for finishing a caulk bead using a caulking finger 100 will now be described in detail. The routine 1000 begins at operation 1002, where the user grips the handle 104 of the caulking finger 100 and applies the finger portion 102 to the caulk bead at operation 1004. At operation 1006, the user pulls the finger portion 102 along the caulk bead while applying pressure to produce a finished caulk bead with the desired characteristics. As discussed herein, the characteristics of the caulk bead may be defined by the selected surface or curvature of the finger portion 102 applied to the caulk, as well as the pressure applied by the user. If desired or necessary, at operation 1008, the user may change the applied pressure and/or the portion (e.g., surface or curvature) of the finger portion 102 that contacts the caulk bead while pulling the caulking finger 100 or after pausing, adjusting the caulking finger 100, and re-starting the finishing process. To facilitate the process, the user may insert one or more fingers inside one or more of the handle cavities 402 that are exposed to a bottom side of the handle 104.

Based on the foregoing, it should be appreciated that technologies for a caulking finger are provided herein. The subject matter described above is provided by way of illustration only and should not be construed as limiting. Various modifications and changes may be made to the subject matter described herein without following the example embodiments and applications illustrated and described, and without departing from the true spirit and scope of the present disclosure, which is set forth in the following claims.

What is claimed is:

1. A caulking finger, comprising:

a handle comprising a finger engagement tab; and a finger portion shaped according to a human finger and coupled to the handle, wherein the finger portion comprises an elastic material and a cross-sectional shape having a plurality of surfaces on a bottom side of the finger portion comprising a plurality of different radii of curvatures, wherein the finger portion comprises a tab engagement recess configured to receive the finger engagement tab of the handle, and wherein a portion of the finger portion encompassing the finger engagement tab comprises a greater rigidity than a portion of the finger portion that does not encompass the finger engagement tab.

2. The caulking finger of claim 1, wherein a first portion of the finger portion comprises a greater rigidity than a second portion of the finger portion.

3. The caulking finger of claim 1, wherein the finger portion comprises a plurality of transverse cross-sectional thicknesses from a tip of the finger portion to a base of the finger portion.

4. The caulking finger of claim 1, further comprising a nail positioned on the finger portion, wherein the nail and a portion of the finger portion adjacent to the nail comprise a plurality of curvatures and angled surfaces, and wherein the nail comprises the elastic material of the finger portion.

5. The caulking finger of claim 1, further comprising a nail positioned on the finger portion, wherein the nail and a portion of the finger portion adjacent to the nail comprise a plurality of curvatures and angled surfaces, and wherein the nail comprises a rigid or semi-rigid material that comprises a greater rigidity than the elastic material of the finger portion.

6. The caulking finger of claim 1, wherein the finger portion comprises a durometer hardness score between approximately 10A and 30A.

7. The caulking finger of claim 1, further comprising a joint located at approximately a position corresponding to a middle portion of the finger portion between a fingertip and a base end, the joint comprising a plurality of surfaces and curvatures.

8. The caulking finger of claim 1, wherein the handle comprises at least one handle cavity exposed to a bottom side of the caulking finger.

9. The caulking finger of claim 8, wherein the handle comprises at least two handle cavities having a handle bridge located between the at least two handle cavities.

10. The caulking finger of claim 9, wherein the at least two handle cavities extend through the handle bridge.

11. A caulking finger, comprising:

a handle;

a finger portion shaped according to a human finger and coupled to the handle, wherein the finger portion comprises an elastic material and a cross-sectional shape having a plurality of surfaces on a bottom side of the finger portion comprising a plurality of different radii of curvatures; and a nail positioned on the finger portion, wherein the nail and a portion of the finger portion adjacent to the nail comprise a plurality of curvatures and angled surfaces, and wherein the nail comprises the elastic material of the finger portion.

12. The caulking finger of claim 11, wherein the handle comprises a finger engagement tab, and wherein the finger portion comprise a tab engagement recess configured to receive the finger engagement tab of the handle.

13. The caulking finger of claim 11, wherein the finger portion comprises a durometer hardness score between approximately 10A and 30A.

14. The caulking finger of claim 11, further comprising a joint located at approximately a position corresponding to a middle portion of the finger portion between a fingertip and a base end, the joint comprising a plurality of surfaces and curvatures.

15. The caulking finger of claim 11, wherein the handle comprises at least one handle cavity exposed to a bottom side of the caulking finger.

16. The caulking finger of claim 15, wherein the handle comprises at least two handle cavities having a handle bridge located between the at least two handle cavities, and wherein the at least two handle cavities extend through the handle bridge.

17. A caulking finger, comprising:

a handle;

a finger portion shaped according to a human finger and coupled to the handle, wherein the finger portion comprises an elastic material and a cross-sectional shape having a plurality of surfaces on a bottom side of the finger portion comprising a plurality of different radii of curvatures; and a joint located at approximately a position corresponding to a middle portion of the finger portion between a fingertip and a base end, the joint comprising a plurality of surfaces and curvatures.

18. The caulking finger of claim 17, wherein the handle comprises a finger engagement tab, and wherein the finger portion comprise a tab engagement recess configured to receive the finger engagement tab of the handle.

19. The caulking finger of claim 17, further comprising a nail positioned on the finger portion, wherein the nail and a portion of the finger portion adjacent to the nail comprise a plurality of curvatures and angled surfaces, and wherein the nail comprises the elastic material of the finger portion.

20. The caulking finger of claim 17, wherein the handle comprises at least two handle cavities having a handle bridge located between the at least two handle cavities, and wherein the at least two handle cavities extend through the handle bridge.

* * * * *